US005799511A

United States Patent [19]

Benderly

[11] Patent Number: 5,799,511

[45] Date of Patent: Sep. 1, 1998

[54] DECORATIVE ARTICLE WITH ENGRAVED HIGH VISIBILITY IMAGE

[75] Inventor: David Benderly, New York, N.Y.

[73] Assignee: NFB of New York, Inc., New York, N.Y.

[21] Appl. No.: 749,023

[22] Filed: Nov. 14, 1996

Related U.S. Application Data

[63] Continuation-in-part of Ser. No. 511,558, Aug. 4, 1995, Pat. No. 5,609,043.

[51] Int. Cl.[6] ..... A44C 25/00

[52] U.S. Cl. ..... 63/23; 63/13; 40/27.5

[58] Field of Search ..... 63/23, 13, 34, 63/35, 18, 3; 24/279; 40/27.5

[56] References Cited

U.S. PATENT DOCUMENTS

| | | | |
|---|---|---|---|
| 1,475,652 | 11/1923 | Polozzi | 40/27.5 |
| 2,145,071 | 1/1939 | Cave | 63/3 |
| 2,763,079 | 9/1956 | Slovitt | 63/34 |
| 2,778,208 | 1/1957 | Flint | 63/23 |
| 2,983,982 | 5/1961 | Solum et al. | 24/279 |
| 3,636,616 | 1/1972 | Remning | 63/23 X |
| 3,898,870 | 8/1975 | Jacobson | 63/23 X |
| 3,964,187 | 6/1976 | Stumpf | 63/23 X |
| 4,891,956 | 1/1990 | MacDonald | 63/23 X |
| 5,414,948 | 5/1995 | Kudo | 63/23 X |
| 5,572,886 | 11/1996 | Katz | 63/34 |
| 5,609,043 | 3/1997 | Benderly | 63/23 |

*Primary Examiner*—David M. Purol
*Attorney, Agent, or Firm*—Kirschstein, et al.

[57] ABSTRACT

An article of jewelry includes an annular support element including a circumferentially extending continuous groove on its inner periphery, and a disc-shaped sandwich mounted on the annular support element by being partially received in its groove. The sandwich includes a transparent protective element; a precious metal substrate carrying an image, especially a laser-engraved relief, on its major surface that faces the transparent protective element; and a bonding agent between the substrate and the element for improving the clarity of the image visible through the element. The annular support element is constructed as a split ring having a gap, and there is provided a mechanism for controlling the size of such gap to tighten the support element around the sandwich.

15 Claims, 1 Drawing Sheet

DECORATIVE ARTICLE WITH ENGRAVED HIGH VISIBILITY IMAGE

CROSS REFERENCE TO RELATED APPLICATIONS

This application is a continuation-in-part of U.S. application Ser. No. 08/511,558, filed Aug. 4, 1995, now U.S. Pat. No. 5,609,043.

BACKGROUND OF THE INVENTION

1. Field of the Invention

The present invention relates to ornamental articles in general, and more particularly to articles of jewelry and methods of making the same.

2. Description of the Related Art

There are already known various constructions of jewelry articles, such as pendants, rings, earrings, charms or the like, among them such which incorporate real precious metal, especially gold, coins. While jewelry of this type has a high degree of aesthetic appeal to many individuals, both would-be owners and mere observers, it is well beyond the means of many of them. While this limited affordability of such items may contribute to their overall appeal, there are still many people who would be willing to pay more for a genuine jewelry article containing real gold or other precious metal rather than a cheap imitation, if only it was not that prohibitively expensive.

The advent of laser technology has created diverse possibilities in many fields of human endeavor in that it made it possible to produce various rather intricate products at a relatively low cost by, among other things, using laser rays to produce a variety of patterns on a substrate or in a layer that coats a substrate by causing the material of such layer or such substrate to evaporate to the requisite depth from selected regions and not from others. Examples of arrangements and methods using this approach can be found, for instance, in the following U.S. Pat. Nos. 3,588,439 to Heller, et al.; 3,665,483 to Becker, et al.; 3,832,948 to Barker; 4,081,653 to Koo, et al.; 4,156,124 to Macken, et al.; 4,480,169 to Macken; and 5,235,154 to Economicos.

As advantageous as the expedients disclosed in these patents may be for the purposes for which they have been developed, they would have only a limited, if any, applicability in the jewelry field, and then only with substantial modifications. Thus, since most if not all of these references deal with metal-coated substrates, they could have some applicability to, say, costume or gold-plated jewelry, a field that is separate and distinct from and totally unrelated, beyond surface resemblance, to the real precious metal jewelry field. In any event, none of these references contains any suggestions how their approaches could be applied in the manufacture of real, rather than metal-coated, jewelry.

Moreover, the use of laser rays causes burn holes or marks on the substrate which detracts from the aesthetic appeal of the engraved pattern. Also, microscopic gaps between the engraved pattern on the substrate and an overlying protective element tend to blur the visibility of the engraved pattern.

OBJECTS OF THE INVENTION

Accordingly, it is a general object of the present invention to avoid the disadvantages of the prior art.

More particularly, it is an object of the present invention to provide a decorative article, especially real jewelry that does not possess the drawbacks of the known jewelry articles of this type.

Still another object of the present invention is to devise a jewelry article of the type here under consideration that not only can be rightfully called a real jewelry article but also does it at a cost amounting to only a fraction of its traditional counterparts.

It is yet another object of the present invention to design the above article of jewelry in such a manner as to be virtually visually indistinguishable from its traditional counterparts unless scrutinized up close.

Another object of the present invention is to improve the clarity of a laser-engraved image formed on the jewelry article.

A concomitant object of the present invention is so to construct the jewelry article of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an article of jewelry comprising a frame or an annular support element having respective inner and outer peripheries, and including a circumferentially extending continuous groove on the inner periphery thereof; and a disc-shaped sandwich mounted on the annular support element preferably by being partially received in the groove thereof, and including a precious metal substrate having an image on a major surface thereof, a transparent protective or confining element overlying the image, and an optically clear bonding agent confined between the substrate and the protective element for improving the clarity of the image visible through the protective element.

A particular advantage of the jewelry article as described so far is that, in the case where the substrate is a foil, an actual gold foil (as opposed to merely a very thin gold-plated layer) can be rightfully considered real jewelry. Yet, because of the relatively low amount of gold or other precious metal contained in the foil, the cost of the article is a mere fraction of its traditional counterpart, i.e. a gold coin modified to form a piece of jewelry, such as a pendant.

According to an advantageous aspect of the present invention, the annular support element is constructed as a split ring having respective spaced end portions defining a gap therebetween. Then, there is further provided means for controlling the size of such gap with attendant tightening of the support element around the sandwich, such controlling means including respective projections on the end portions of the support element, one having a through opening and the other a threaded bore, and a screw-like tightening element passing through the through bore and threaded into the threaded bore and having an enlarged head portion engaging the one projection next to the through bore thereof.

It is particularly advantageous when the aforementioned image is a laser-engraved relief on the major surface of the substrate. The relief is formed by directing a laser through the transparent protective element.

In accordance with this invention, the bonding agent is applied over the relief in a liquid, paste, or aerosol manner. The agent is transparent to visible light and is preferably cured by ultraviolet light, or by a combination of air, heat or time factors. The index of refraction of the cured agent matches that of the protective element, which is advantageously either glass or plastic. The cured agent serves to improve the clarity of the engraved relief visible through the protective element by filling in microscopic gaps or spaces formed between the substrate and the protective element.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
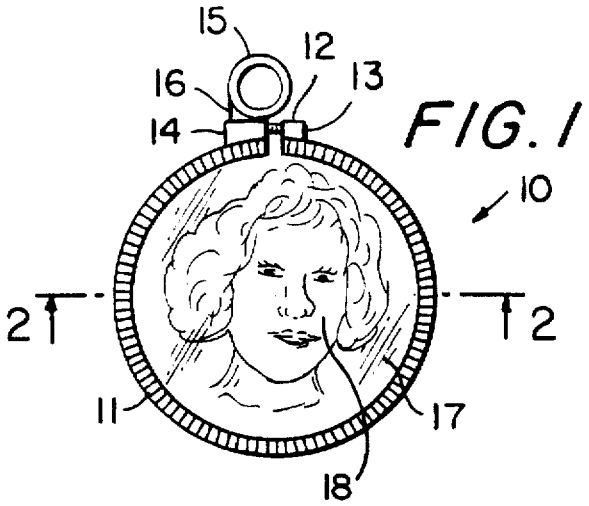
FIG. 1 is a top elevational view of one embodiment of a jewelry article embodying the present invention, on a slightly enlarged scale.

Referring now to the drawing in detail, and first to FIG. 1 thereof, it may be seen that the reference numeral 10 has been used therein to identify a first embodiment of a jewelry article embodying the present invention in its entirety. As shown, the jewelry article 10 includes, as one of its main components, an annular support element or frame 11 that is constructed as a split ring in that it is circumferentially incomplete, having two end portions that are spaced a certain, albeit a rather small, distance or gap apart.

A first projection 12, which may advantageously have a substantially cylindrical configuration, is integrally provided on one of such end portions. The projection 12 has a substantially smooth hole therethrough through which a screw 13 having an enlarged head passes on its way toward a second projection 14 of a configuration similar to that of the projection 12. The projection 14 which, like the projection 12, is of one piece with or securely permanently connected to the splitring support element 11, but this time to its other end portion across the gap from the first projection 12, is provided with an internally threaded hole into which the externally threaded shank of the screw 13 is threaded.

For reasons that will become apparent as the present description proceeds, it is desired to make the existence of the aforementioned gap in the annular support element 11 and of the associated ring tightening mechanism 12 to 14 as inconspicuous as possible. For this reason, the mechanism 12 to 14 is disguised as nothing more than a protuberance on the outer periphery of the jewelry article 10 serving the purpose of connecting an eyelet 15 to the jewelry article 10 in cooperation with an upstanding web 16, as is usual when a jewelry piece is to be worn as a pendant suspended from a chain wound around the neck, the wrist, or another part of the body of the user.

It will be appreciated that tightening of the screw 13 will result in a reduction in the size of the aforementioned gap and thus the tightening of the annular support element 11 around whatever may be present in the space surrounded by it. As a comparison of FIGS. 1 and 2 with one another will reveal, what the split-ring support element is tightened around is a sandwich consisting of a circular central substrate 17 carrying at least one image 18 on at least one of its major surfaces and confined between two disk-shaped protective or confining elements 19 and 20 each juxtaposed with one of its major surfaces.

According to one embodiment of the present invention, the central substrate is constituted by a very thin disk and preferably merely a foil of precious metal, such as gold, silver or platinum. Such thin foils are rather inexpensive in view of the relatively minute amount of the precious metal they contain; yet, when properly mounted and embellished by the respective images 18, they can be made virtually indistinguishable from much thicker and hence considerably more expensive articles, such as gold or silver coins. And this is where the present invention comes in: to give the article 10 the appearance of an expensive piece of jewelry, such as a pendant, incorporating a precious metal coin, without incurring the expense of using an actual coin.

Of course, such a thin foil of precious metal, the thickness of which may be expressed in fractions of a millimeter, typically amounting to only a few tens or hundreds of a micrometer, is not self supporting, that is, it cannot be mounted in the supporting element 11 by itself. This is why it is proposed by the present invention to confine it between the two confining elements 19 and 20.

However, it will be realized that the presence and use of the confining elements 19 and 20 must not detract from the impression that a solid gold coin is being used or embedded in the piece of jewelry 10. Hence, at least that of the confining elements 19 and 20 that is visible when the jewelry piece is being worn (element 19 in the illustrated example) is made of a transparent material with just the amount of luster or sheen to it that would be expected from the precious metal itself. Yet, since in an application like that illustrated in the drawing, it cannot be reliably assured that the confining element 19 will be the one facing away from the body of the user under all circumstances, it is currently preferred to give the confining element 20 the same properties that the confining element 19 possesses. Preferably, both confining elements are constituted of a rigid plastic, such as Lucite, or glass, having a thickness on the order of one-half a millimeter. In some cases, it may be desired to constitute one of the confining elements as a transparent spray coating applied over the image 18.

Figure 2:
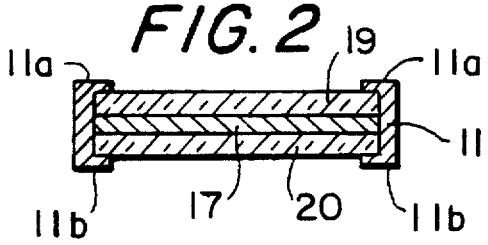
FIG. 2 is an even more enlarged cross-sectional view taken on line 2—2 of FIG. 1.

It may be seen particularly in FIG. 2 of the drawing that the support element 11 has a pair of circumferentially extending ribs or ridges **11*a* and 11*b* on its inner periphery. It should be evident that such ridges 11*a* and 11*b* hold the confining elements 19 and 20 and thus the entire sandwich 17 to 20 between themselves in the assembled condition of the jewelry article 10. To achieve this purpose, it is currently preferred to space them apart by a distance that substantially corresponds to the overall thickness of the sandwich 17 to 20 or is even slightly smaller, to obtain a snug or frictional fit, or even a slight interference fit, of the sandwich 17 to 20 in the thus formed groove in the support element 11. This type of a fit will not only avoid the otherwise existing danger that the jewelry piece 10 would betray its character by rattling of the sandwich 17 to 20 in its mount 11, but also assures that the image 18** retains its originally selected orientation (e.g. top of the head of a person depicted on the "coin" up).

As mentioned before, in applications such as that depicted in the drawing, it is not always sure which side of the jewelry article 10 will face the observer. For this reason, it is proposed by the present invention to provide another image on the obverse side of the "coin" as well, either by providing it on the opposite major surface of the very same central substrate 17, or by using a pair of such central substrates 17 instead, each carrying its own image 18 and oriented in such a manner in the sandwich 17 to 20 that its image 18 will face outwardly, that is toward the respective overlying confining element 19 to 20 to be visible through the latter.

Figure 3:
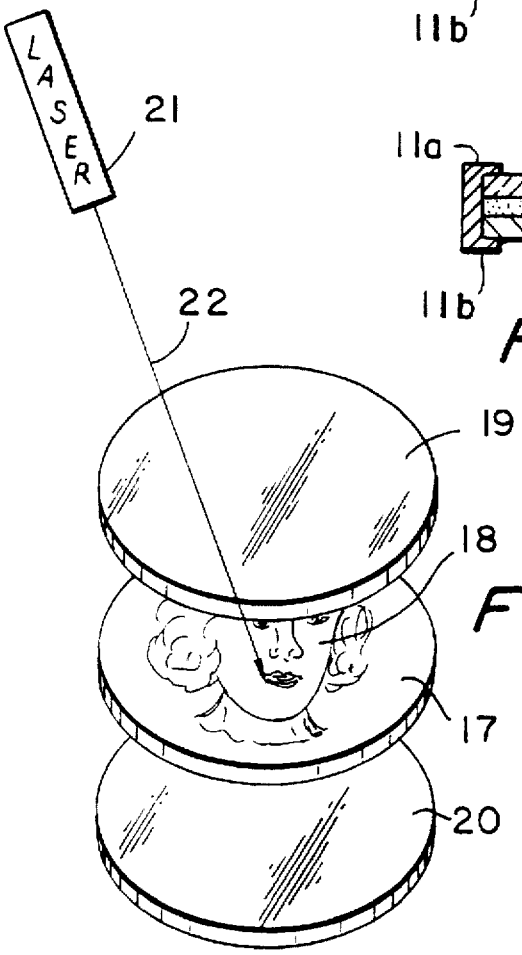
FIG. 3 is an exploded view of certain components of the jewelry article of FIG. 1 drawn to a scale substantially corresponding to that of FIG. 2, and also indicating a step in the production of the article.

The image 18 is advantageously provided on the respective foil 17 in a manner indicated in FIG. 3 of the drawing. As shown there, it is produced by laser ablation or engraving, in that a laser beam 22 issued by a laser 21 is controlled in such a manner as to evaporate the metal from selected regions of the respective major surface of the precious metal foil 17 while leaving other regions intact. It is sufficient to selectively remove the material merely to the depth amounting to just a few angstroms or micrometers to create an impression of a relief reminiscent of that of a real coin. How this laser etching is achieved and how the laser beam is controlled to accomplish it are well known to those skilled in the art, among others from the previously cited references.

As illustrated, the laser etching can be performed either during the assembly of the jewelry piece 10 or even after it has been assembled, by directing the laser beam against the affected major surface of the foil through the respective transparent confining element 19. Of course, the material of the confining element 19 has to be transparent to the wavelength at which the laser 21 issues its radiation, that is, it must not exhibit more than a nominal absorptivity at that wavelength, since otherwise the laser beam 22 would wear away or destroy the material of the confining element 19 rather than that of the foil 17.

Assuming this to be the case, it is then possible to have the respective confining element 19 interposed in the path of propagation of the laser beam 22, provided that it is assured that the metal evaporated by the laser beam will be able to escape from its point of origin without becoming deposited on other regions of the sandwich 17 to 20, such as those of the respective confining element 10. This criterion, however, can be usually satisfied even when the article 10 is already assembled prior to the commencement of the laser etching operation, given the fact that the interface between the elements 17 and 19, as minute as it may be in human terms, is still quite sizable as far as the escape of the precious metal vapor through it is concerned.

To further enhance the resemblance of a real coin, the annular support element 11 may further be provided on its outer periphery with a series of alternating ridges and grooves like those found on many actual coins. This expedient is so well known that it has not been illustrated in the drawing in order not to unduly encumber the same. Of course, the jewelry article 10 will not fool anybody on close observation; it could not be passed on for value as the "real McCoy". However, when worn in the intended manner, it gives the impression reminiscent of a much more expensive jewelry piece and, because it contains actual precious value, even its intrinsic value is more than just nominal. Hence, an article of jewelry 10 of this type has both an aesthetic and sentimental appeal that cannot be matched by so-called costume jewelry or other cheap jewelry imitations that are usually made of or contain non-precious metals and are at most plated with the respective precious metal.

Figure 4:
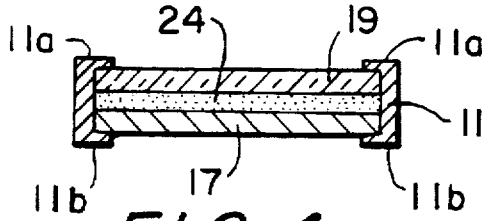
FIG. 4 is a cross-sectional view akin to that of FIG. 2, but of another embodiment of the jewelry article according to this invention.

Turning now to a second embodiment of the invention as illustrated in FIG. 4, the substrate 17 need not be a non-self-supporting foil, but could also be a self-supporting, thin disk, approximately 4 mils thick. As before, the substrate should be of a precious metal. The disk 17 need only have one overlying protective element, rather than the two protective elements described above. The protective element can also be constituted as a clear coating applied over the substrate.

In accordance with another feature of this invention, a curable, optically clear bonding agent 24 is applied over the etched pattern in the substrate. The agent 24 is applied in the form of a liquid, paste or spray and cures, preferably by exposure to ultraviolet light. Air, heat or time curing can also be used.

The agent 24 fills in the microscopic gaps and spaces between the substrate and the protective element, both of which have surface imperfections. The index of refraction of the cured agent matches that of the protective element, be it glass or plastic. The interface between the substrate and the protective element is thus uniformly clear to visible light and provides a clear image of the etched pattern through the protective element. The cured agent also serves to physically bond the protective element and the substrate so that no relative movement occurs. Also, the cured agent waterproofs the interface, which is of especial benefit during swimming and showering activities.

In case both surfaces of the substrate are etched, then a pair of protective elements are used, one overlying each major surface of the substrate, in which case the bonding agent is applied between each protective element and each etched surface of the substrate.

It will be understood that each of the elements described above, or two or more together, may also find a useful application in other types of constructions differing from the type described above.

For example, the article need not have a circular coin shape as shown, but could have other non-circular configurations.

While the present invention has been described and illustrated herein as embodied in a specific constructions of an article of jewelry, it is not limited to the details of this particular construction, since various modifications and structural changes may be made without departing from the spirit of the present invention.

Thus, any decorative article on which an engraved image is to be displayed is contemplated by this invention. Such articles include, for example, pens, cosmetic cases, business card holders, etc.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims:

I claim:

1. A decorative article comprising:

a) a frame; and b) a sandwich mounted on said frame and including a transparent protective element having an index of refraction, a precious metal substrate carrying an etched image on a major surface thereof that faces said protective element, and an optically clear bonding agent between said protective element and said substrate, and having an index of refraction matching that of said protective element for improving the clarity of the etched image visible through said protective element.

2. The decorative article as defined in claim 1, wherein said frame is an annular support element constructed as a split ring having respective spaced end portions defining a gap therebetween; and further comprising means for controlling the size of such gap with attendant tightening of said support element around said sandwich, including respective projections on said end portions of said support element, one having a through opening and the other a threaded bore, and a screw-like tightening element passing through said through bore and threaded into said threaded bore and having an enlarged head portion engaging said one projection next to said through bore thereof.

3. The decorative article as defined in claim 1, wherein said frame is an annular support element having respective inner and outer peripheries, and including a circumferentially continuous groove on said inner periphery thereof; and wherein said sandwich is partially received in said groove.

4. The decorative article as defined in claim 1, wherein said substrate is a non-self-supporting foil, and wherein said image is a laser-engraved relief on said major surface of said foil.

5. The decorative article as defined in claim 1, wherein said substrate is a rigid disc.

6. The decorative article as defined in claim 1, wherein said protective element is constituted of a light-transmissive, synthetic plastic material.

7. The decorative article as defined in claim 1, wherein said bonding agent is constituted of an ultraviolet-curable substance.

8. The decorative article as defined in claim 1, wherein said bonding agent occupies gaps between said protective element and said substrate.

9. The decorative article as defined in claim 1, wherein said protective element has an index of refraction, and wherein said bonding agent has an index of refraction matching that of said protective element.

10. A method of making a decorative article, comprising the steps of:

a) engraving an etched relief on a major surface of a substrate;

b) positioning a transparent protective element having an index of refraction in overlying relationship with said major surface of said substrate;

c) applying an optically clear bonding agent having an index of refraction matching that of said protective element between said major surface of said substrate and said protective element to form a sandwich; and d) mounting the sandwich on a frame.

11. The method as defined in claim 10, wherein the engraving step is performed by directing a laser beam through said transparent element.

12. The method as defined in claim 10, wherein said applying step is performed by applying said bonding agent in a flowable medium.

13. A decorative article comprising:

a) a frame; and b) a sandwich mounted on said frame and including a transparent protective element, a non-self-supporting precious metal foil substrate carrying a laser-engraved relief image on a major surface thereof that faces said protective element, and an optically clear bonding agent between said protective element and said substrate for improving the clarity of the image visible through said protective element.

14. The decorative article as defined in claim 13, wherein said metal foil subtrate is gold.

15. A method of making a decorative article, comprising the steps of:

a) engraving a relief on a major surface of a substrate;

b) positioning a transparent protective element in overlying relationship with said major surface of said substrate, said engraving step being performed by directing a laser beam through said transparent element;

c) applying an optically clear bonding agent between said major surface of said substrate and said protective element to form a sandwich; and d) mounting the sandwich on a frame.

* * * * *